United States Patent [19]

Hepburn et al.

[11] Patent Number: 4,694,744

[45] Date of Patent: Sep. 22, 1987

[54] HYDRAULIC PRESS WITHOUT CONVENTIONAL SIDE SLABS AND CROSS-HEAD

[75] Inventors: James Hepburn; Leon Malashenko, both of Toronto, Canada

[73] Assignee: John T. Hepburn, Limited, Mississauga, Canada

[21] Appl. No.: 924,927

[22] Filed: Oct. 30, 1986

[30] Foreign Application Priority Data

Dec. 30, 1985 [CA] Canada ..... 498799

[51] Int. Cl.[4] ..... B30B 7/02

[52] U.S. Cl. ..... 100/214; 100/257; 100/219; 100/269 R; 100/258 A

[58] Field of Search ..... 100/214, 269 R, 46, 100/258 R, 219, 224, 258 A, 257; 264/40.5, 325

[56] References Cited

U.S. PATENT DOCUMENTS

| | | | |
|---|---|---|---|
| 3,938,362 | 2/1976 | Falk et al. | 100/214 |
| 4,283,825 | 8/1981 | McKay et al. | 100/257 X |
| 4,295,358 | 10/1981 | Bulmer | 100/214 |
| 4,470,346 | 9/1984 | Nelson | 100/214 |

*Primary Examiner*—Werner H. Schroeder
*Assistant Examiner*—Andrew M. Falik

[57] ABSTRACT

A 2000 ton hydraulic press is designed to eliminate the side slabs and substantial cross-head associated with conventional presses. The press simply has a base that includes a lower platen and bolster plate. Four vertical posts extend upwardly through the lower platen bolster plate, and guide structure beneath the lower platen bolster plate constrains the posts to move vertically while bearing horizontal forces and bending moments which may be applied to posts for example during compression of a mold containing a molding charge. Four large-bore, short-stroke hydraulic cylinders are attached to the base below the lower platen bolster plate, and serve to raise and lower the posts during compression phases of operation. An upper platen is interfitted with and guided exclusively by the posts for vertical movement, and a pair of small-bore, long stroke cylinders operating between the lower and upper platens serve to raise and lower the platen in a rapid manner in preparation for and following compression-phase operations. Hydraulically actuated locking mechanisms carried by the upper platen permit the upper platen to be fixed to the posts so that the four large bore cylinders can be actuated to draw both the posts and the upper platen downwardly, as during compression of a workpiece between the platens.

9 Claims, 4 Drawing Figures

HYDRAULIC PRESS WITHOUT CONVENTIONAL SIDE SLABS AND CROSS-HEAD

FIELD OF THE INVENTION

The invention relates generally to hydraulic presses, and more specifically, though not exclusively, to presses intended to apply high compressive forces.

DESCRIPTION OF THE PRIOR ART

Presses used in compression molding have generally comprised a rigid steel frame with a base, a pair of opposing side slabs and an upper cross-head. An upper platen is fitted between the side slabs and guided on appropriate guide surfaces machined or otherwise provided on the side slabs. A lower platen, positioned to confront the upper platen, is supported from the base by a multiplicity of short-stroke hydraulic cylinders. A large bore, long-stroke, central ram, suspended from the cross-head, has generally served as means for advancing the upper platen towards the lower platen, to reduce the substantial separation existing between an upper mold member and a lower mold member, commonly fixed to the platens at the start of the molding cycle. The upper platen is commonly advanced until it engages mechanical stops attached to the side slabs, and a comparatively small separation exists between the mold members. The ram is then urged under full working pressure against the mechanical stops during the subsequent compression stage of operation. The lower platen is then advanced by means of the four short-stroke hydraulic cylinders to compress the upper and lower mold members, and more specifically, to compress a molding charge placed between the mold members. The upward force of the short-stroke cylinders is of course resisted by the central cylinder suspended from the cross-head.

Sensors are positioned at a number of locations between the upper and lower platens to provide information regarding relative tilting of the platens. Appropriate controls responsive to the sensors regulate operation of the four short-stroke cylinders, individually, to ensure parallel pressing. Compression molding processes operating in this manner are well known, and a typical parallelism control is described, for example, in U.S. Pat. No. 4,076,780 which issued on Feb. 28, 1978 to Edwin D. Ditto.

Such presses have a number of disadvantages. The central ram, which must have both a long-stroke and a capacity to accommodate the full compressing force generated by the prss, is large and expensive. Cycle time tends to be very slow, because of the time delay inherent in advancing a large bore, large-stroke cylinder. A large reservoir of hydraulic fluid is required to accommodate the capacity of the central cylinder and the expansion required of the cylinder. The housing must be massive and very robust to withstand the forces generated during compression.

Presses which embody a high degree of parallelism control and which eliminate the need for a large central ram and robust support structure have recently become available. Such presses incorporate a movable lower platen supported by a multiplicity of short-stroke, large bore hydraulic cylinders which are actuated only during the compression phase of operation. A movable upper platen is interfitted with cylindrical guide posts, rigidly fixed to an associated support structure, that guide the upper platen towards and away from the lower platen. The separation between the platens can be quickly reduced by means of small bore, long-stroke cylinders which act between the frame and upper platen until the compression phase of operation can be commenced. What is believed to be a hydraulically-actuated, chuck-like clamping mechanism, carried in the interior of and fixed to the upper platen, is then actuated to friction grip the cylindrical guiding surfaces of the posts thereby fixing the upper platen to the guide posts. The lower platen is then advanced by means of the short-stroke cylinders, with sensors regulating operation of the cylinders to ensure parallelism, to compress a work-piece between the platens. Such presses are very expensive, and, because the lower platen must move, lack versatility, not readily permitting the implementation, for example, of certain high-pressure injection molding processes in which mold members are clamped between upper and lower press platens and a nozzle engaged with the mold.

The present specification describes a press design which eliminates the need for side slabs and a robust cross-head, which has a stationary lower platen that accommodates injection molding processes, which permits relatively fast cycle times and which is less expensive to manufacture than certain prior presses of comparable size. Although the press design lends itself inherently to platen parallelism control, it should be noted that the present specification is directed primarily to overall press construction, not to the implementation of the requisite hydraulic control for platen parallelism control, and that the advantages associated with the design are obtained in embodiments which do not incorporate platen parallelism control.

BRIEF SUMMARY OF THE INVENTION

The invention provides a press including a base structure which defines a lower platen. The press a multiplicity of vertical posts, and hydraulic cylinder means attached to the base structure which serve to raise and lower the posts. Guide means attached to the base structure and continually engaged with the posts constrain the posts to move vertically. An upper platen is guided on the posts for vertical movement relative to the lower platen, and upper platen displacement means (preferably in the form of a pair of long-stroke short-bore hydraulic cylinders acting between the base structure and the upper platen) serve to move the upper platen vertically on the posts. Controllable locking means permit the upper platen to be locked to the vertical posts so that the hydraulic cylinder means may then raise and lower both the upper platen by acting on the posts.

Various inventive aspects and advantages associated with a preferred embodiment of the press will be described in greater detail below.

DESCRIPTION OF THE DRAWINGS

The invention will be better understood with reference to drawings illustrating a preferred embodiment in which.

DESCRIPTION OF PREFERRED EMBODIMENT

Figure 1:
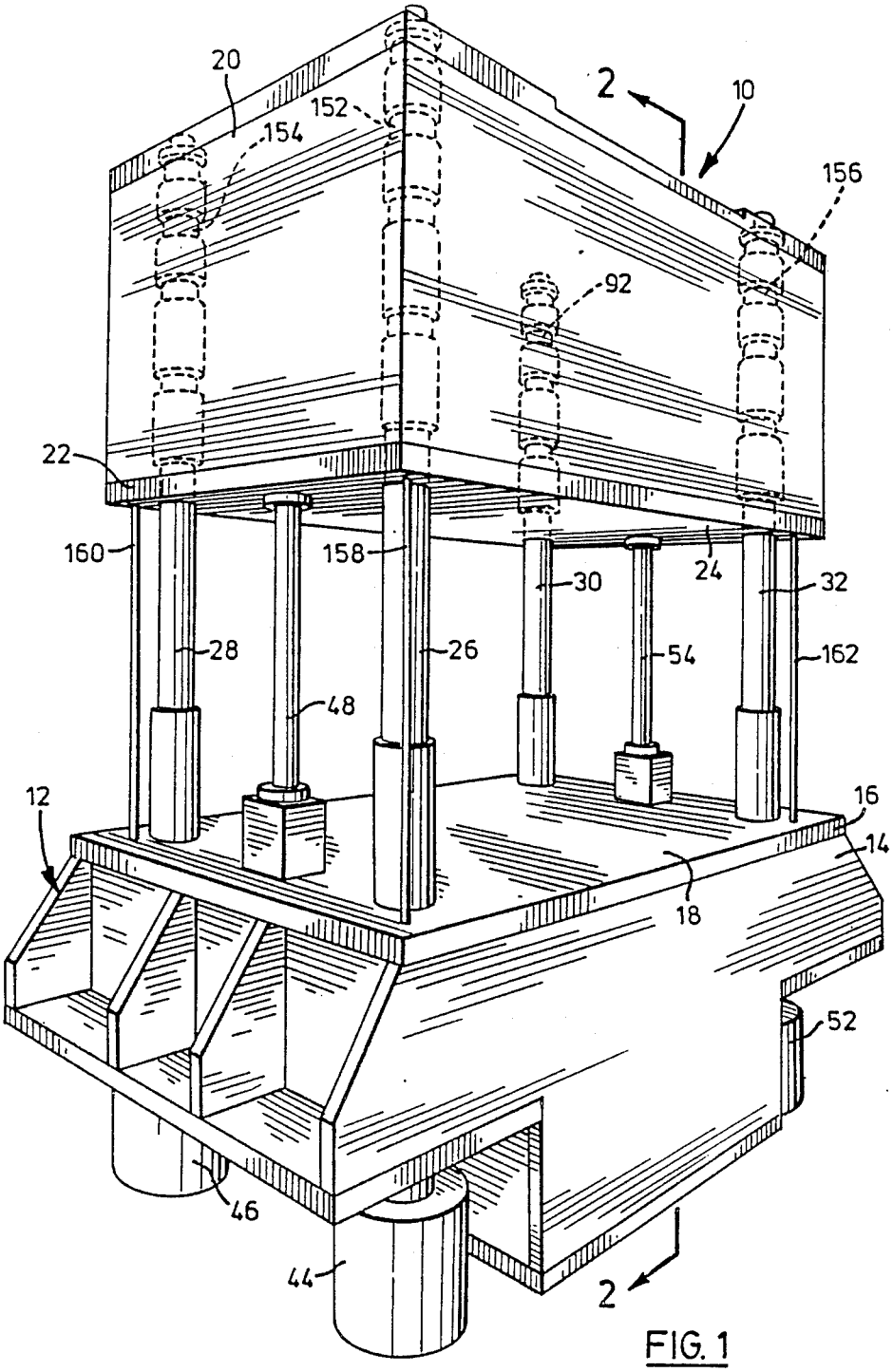
FIG. 1 is a perspective view of a press viewed from a front corner.

Reference is made to FIG. 1 which illustrates a preferred embodiment of the invention, a hydraulic press 10 having a 2,000 ton capacity. The press 10 will be described with reference to a compression molding process; however, the invention should not be viewed as limited to such applications.

The design of the press 10 permits the hydraulic pumps and motors required for operation of the press 10 to be mounted entirely at ground level. This reduces the overall height of the press and significantly reduces the cost of installing the required hydraulic equipment and conduits. The hydraulic fluid lines associated with the press (which are numerous) have for the most part been omitted in the drawings to avoid obscuring detail. The appropriate installation of such lines will be readily apparent to those familiar with press design and the operation of hydraulic cylinders.

The press 10 has a base structure 12 of a steel plate construction. The base structure 12 defines a fixed lower platen 14, the upper surface of which is defined by a conventional T-slotted steel bolster plate 16 (T-slots not illustrated) that permits a mold member to be attached with appropriate bolts. The bolster plate 16 has an upper surface 18 which constitutes the uppermost surface of the lower platen 14 that normally engages a work-piece during the compression phase of operation. The lower platen 14 is reinforced in a customary manner to withstand the loads expected during the press's compression phase of operation.

The press 10 has a movable upper platen 20 which includes a conventional T-slotted bolster plate 22 (T-slots not illustrated) to which an upper mold member can be bolted and which defines the lowermost surface 24 of the upper platen which acts against a work-piece during the compression phase of operation. The upper platen 20 is reinforced by a network of steel plates welded at right angles to provide the rigidity required to withstand any significant deflection during the press's compression phase of operation.

The upper platen 20 is interfitted with and guided for vertical movement to and from the lower platen 14 solely by four posts 26,28,30,32. The upper platen 20 has four vertical passages, each aligned with a different one of the four posts 26–32 and each dimensioned at upper and lower ends to closely receive the associated post. The passage 34 associated with the post 30 is typical. The passage 34 has an opening at the top of the upper platen defined by a bushing 36 which conforms in inner dimension to the radially outermost dimension of an upper portion 38 of the post 30. The passage 34 has another opening at the bottom of the upper platen 20 defined by a split insert collar 40. The upper and lower openings defined by the bushing 36 and collar 40 have different dimensions, and the split collar 40 permits assembly of the post 30 within the upper platen 20 despite the different opening sizes and irregularities in the outer dimensions of the post 30. An upper plate 42 to which the posts 26–32 are attached fixes the spacing between free ends of the posts 26–32, and replaces the massive cross-head commonly associated with may prior presses. The upper plate 42 is not strictly required to provide an operative press but is preferred.

Four compression-phase hydraulic cylinders and two rapid advance cylinders are provided to raise and lower the upper platen 20. All of these cylinders are of the double-acting type. The compression-phase cylinders act between the upper and lower platens 14, 20 through the vertical posts 26–32. These cylinders are used primarily during the compression phase of operation to compress a molding charge between upper and lower mold members and for initial separation of the mold members following processing of the charge, during which phases of operation the upper platen 20 is fixed to the posts 26–32 by mechanisms described more fully below. The rapid advance cylinders are used for gross positioning of the upper platen 20 relative to the lower platen 14 either prior to compression or subsequent to mold separation, and act directly between the base structure 12 and the upper platen 20 when the upper platen 20 is not locked to the posts 26–32. Their function is primarily to permit quick separation of the platens for interchangement of mold parts or introduction of a molding charge. The six cylinders are arranged in two identical sets of three each: one set consists of two compression-phase cylinders 44,46 and one rapid advance cylinder 48; the other set consists of two compression-phase cylinders 50,52 and one rapid advance cylinder 54. Only one such set will be described in detail, the corresponding cylinders of the other set being substantially identical and similarly mounted.

Figure 2:
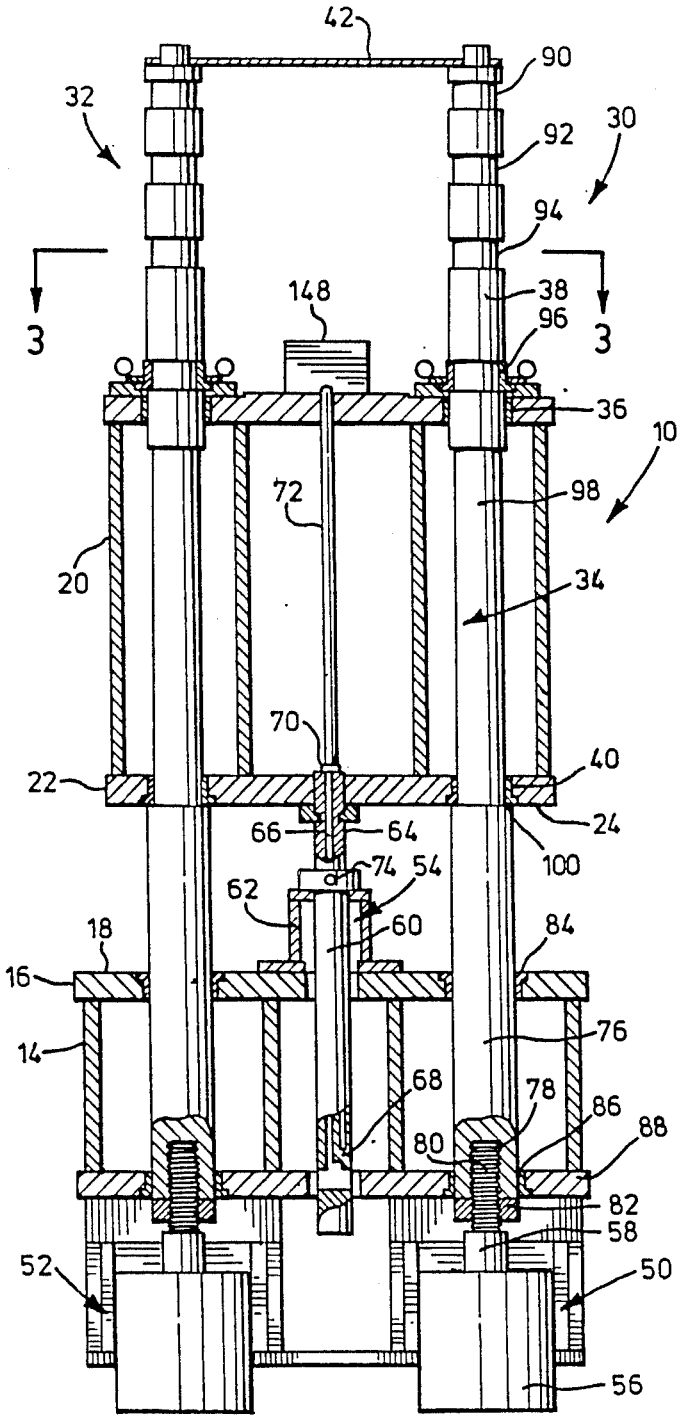
FIG. 2 is a view along the lines 2—2 of FIG. 1 (with a number of press components not in section and others fragmented for clarity)

The cylinder set consisting of the two compression-phase cylinders 50,52 and the rapid advance cylinder 54 will be discussed with reference to FIG. 2 where the various cylinders are illustrated in greater detail. The compression-phase cylinders 50, 52 are short-stroke (6 inch), large bore cylinders sized to apply substantial compression forces. About 1 inch of travel is actually required during compression of a work-piece; the remaining 5 inches being available to accommodate varying mold heights. The cylinders 50, 52 are bolted to the base structure 12 a preselected distance below the bolster plate 16 in recesses external to the base structure 12. The cylinder 50 which is typical of all four compression-phase cylinders has a body member 56 fixed to the base structure 12 and a piston rod 58 which moves vertically relative to the body member 56 under the influence of hydraulic oil under pressure.

The rapid advance cylinder 54 is a long-stroke, narrow bore cylinder sized primarily to accommodate the weight of the upper platen 20. The cylinder 54 has a body member 60 which is bolted to the lower platen 22 by means of an intermediate steel support structure 62. The associated piston rod 64 is attached to the upper platen 20 at its T-slotted plate 22. The piston rod 64 which moves with the upper platen has a hollow bore 66 accessible at opposing rod ends 68, 70 for receipt and transfer of hydraulic oil. A conduit 72, in communication with the open rod end 70, extends through the interior of the upper platen 20 to uppermost platen surfaces. The conduit 72 serves to communicate hydraulic oil to hydraulically-actuated locking mechanisms which are mounted on the top of the upper platen 20. The hydraulic cylinder 54 is adapted in the standard manner to receive and exhaust hydraulic fluid at its upper and lower ends, and, in particular, has a fluid port 74 at its upper end which communicates with the interior cylinder region surrounding the piston rod 64. When the piston rod 64 is fixed against movement (by closing the appropriate valve to prevent fluid movement into and out of the lower end of the hydraulic cylinder 54), as when movement of the upper platen 20 is discontinued, hydraulic fluid can be pumped into the fluid port 74 and through the conduit 72 to the locking mechanisms on the platen. The corresponding rapid advance cylinder 48 is similarly adapted for passage of hydraulic fluids, but functions as a return line for hydraulic fluid flows. This is a singularly advantageous arrangement which facilitates the running of hydraulic fluid lines to the locking mechanisms.

The four vertical posts 26–32 are supported each from a different one of the four compression-phase cylinders. The mounting of the post 30 which is typical will be discussed with refernece to the end view of FIG. 2. The post 30 extends through an opening provided in the bolster plate 16 of the lower platen 14, and has a lower end portion 76 formed with a threaded opening 78. The opening 78 receives a threaded end portion 80 of the piston rod 58 associated with the compression-phase cylinder 50, and a lock nut 82 secures the threaded connection. The post 30 can accordingly be raised and lower by the compression-phase cylinder 50.

The vertical posts 26–32 are constrained to move vertically by guiding means mounted in the base structure 12 below the upper platen surface 18. The guiding structure associated with the post 30, which is typical, will be described in detail. The guiding structure includes an upper bushing 84 below and mounted flush with the upper surface 18 of the lower platen 14, and a lower bushing 86 aligned with the upper bushing 84 and mounted in a plate 88 forming part of the lower platen 14. The upper and lower bushings are dimensioned to closely receive the lower portion 76 of the post 30, and their spaced apart relationship ensures that bending moments applied to the post 30 by horizontal forces arising during operation are properly resisted by the bushings 84, 86 and their surrounding mounting structure. The comparatively short-stroke of the compression phase cylinder 50 ensures that the post 30 is continually engaged by the bushings thereby reinforcing the posts against horizontal forces during all phases of operation. This rigid guiding arrangement is particularly important since the upper platen 20 is guided exclusively on the posts 26–32.

The post 30 is formed with a multiplicity of vertically spaced-apart, annular recesses that are radially symmetric about the longitudinal axis of the post 30. The post 30 has a total of four such recesses, identified by reference numerals 90, 92, 94, 96 in FIG. 2), and the other posts have a substantially identical recessed construction. The lower end portion 76 of the post 30 is enlarged relative to a central post portion 98 and defines an annular shoulder 100. The shoulder 100 of the post 30 together with similar shoulders on the other posts define a stop limiting lowering of the upper platen 20 relative to the posts. The shoulders are placed at a predetermined position along the length of each post, the position having been so selected that, when all compression-phase cylinders are fully extended, the shoulders align horizontally, spacing the upper platen 20 a predetermined distance from the lower platen 22 in substantially parallel relationship.

It should be noted that the threaded mounting of the posts on the piston rods associated with the compression-phase cylinders permits mechanical adjustment of the parallel relationship of the upper and lower platens (if stricter electronic parallelism control is not provided), and also mechanical adjustment of the height of the shoulders to accommodate different mold heights. In the latter respect, it should be noted that electronic sensing and hydraulic adjustment of the shoulder height is preferred. This can be accomplished by employing compression-phase cylinders of the type having built-in extension sensors and associated electronic and hydraulic controls appropriately calibrated to regulate shoulder height rather than overall piston rod extension.

Figure 4:
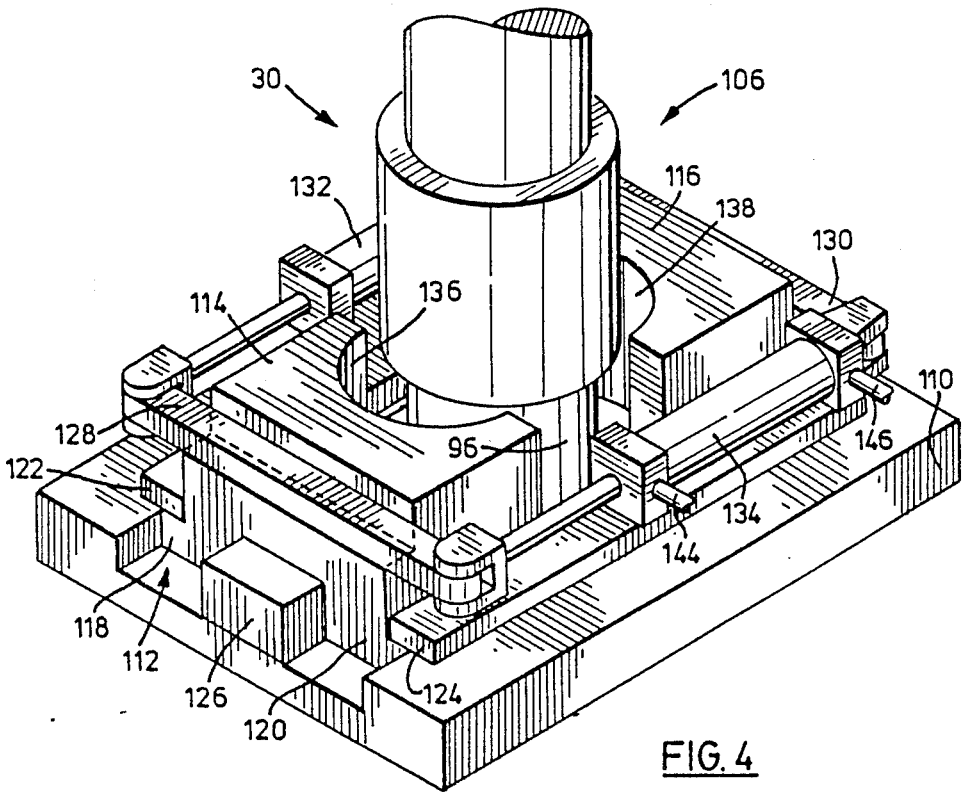

Four hydraulically-actuated lock mechanisms 102, 104, 106, 108 are fixed to the top of the upper platen 20. These act between the upper platen 20 and the posts, and serve to lock the upper platen 20 to the posts in a controllable and releasable manner. One locking mechanism is associated with each of the vertical posts, and the construction of the locking mechanism 106 associated with the post 30 is detailed in the isometric view of FIG. 4. The lock mechanism 106 has a rectangularly steel base plate 110 formed with an open-ended channel 112. The channel 112 crosses or intersects the passage 34 at the upper surface of the platen 20 (as apparent in FIG. 2) where the base plate 110 is apertured to permit vertical passage of the post 30. An identical pair of steel lock members 114, 116 are mounted for horizontal sliding movement in the channel 96, one horizontally to either side of the vertical passage 34. The lock member 114 has a pair of opposing longitudinal flanges 118, 120. These flanges are overlaid by a pair of steel plates 122, 124, bolted to the base plate 110, flush with an upper surface thereof. A steel stop 126 is bolted to the base plate 110 after mounting of the lock members 114, 116 in the channel 112. A corresponding stop (not illustrated) is mounted outwardly of the locking member 116. A bar 128 is bolted to the lock member 114 transverse to the direction of sliding movement, and a corresponding bar 130 is similarly mounted on the other lock member 116. The bars 128, 130 are joined by a pair of hydraulic cylinders 132, 134 using standard clevis connections. The cylinders 132, 134 can accordingly be selectively actuated to draw the lock members together or to separate them. The locking members 114, 116 are formed with semi-circular recesses 136, 138, respectively, conforming to post surfaces in the interior of the post recess 96. In an unlocked position (FIG. 4) the lock members 114, 116 are disengaged from the post recess 96, permitting movement of the upper platen 20 relative to the post 30. In a locked position (FIG. 2), the locking members 114, 116 are engaged in the post recess 96, effectively locking the upper platen 20 to the post 30. The stops associated with the locking members 114, 116 ensure proper disengagement of the locking members from the recess 96, providing for the possibility that one locking member will move in preference to the other.

The manner in which hydraulic fluid is supplied and returned from the lock mechanism 106 for actuation of the hydraulic cylinders 132, 134 overcomes problems potentially created by movement of the upper platen 20. For example, the hydraulic cylinder 134 receives hydraulic oil via two flexible conduits 144, 146 (extensively fragmented) which permit application of pressure to the appropriate end of the cylinder 134 for either extension or contraction. The two conduits 144, 146 are coupled through a conventional flow switching valve 148 to the open rod end 70 of the rapid advance cylinder 54 for receipt of the required hydraulic oil under pressure. The flow switching valve 148 permits hydraulic oil under pressure to be applied selectively to the two conduits 144, 146 (and corresponding conduits on the cylinder 132) so that the lock members 114, 116 can be moved selectively between their locked and unlocked positions. Hydraulic fluid displaced from the cylinder 134 through the non-pressurized one of the conduits 144, 146 is directed by the flow switching valve 148 via a conduit 150 to the bore formed in the other rapid advance cylinder 48. The two rapid advance cylinders 48, 54, intervening conduits and flow switching valve 148 effectively provide a hydraulic fluid circuit which eliminates the need to run flexible conduits to the upper platen 20, an alternative which is complicated by the extent of travel of the upper platen 20, or the need for mounting of hydraulic pumping equipment and fluid reservoirs on or above the upper platen, an alternative which increases the cost and overall height of the press. The rapid advance cylinder 48 effectively serves as a supply line of hydraulic oil under press; the other rapid advance cylinder 54 effectively serves as a return line. It will be understood that the other cylinder 132 associated with the locking mechanism 106 is similarly operated. All hydraulic pumps required by the press 10 are accordingly mounted at ground level.

Figure 3:
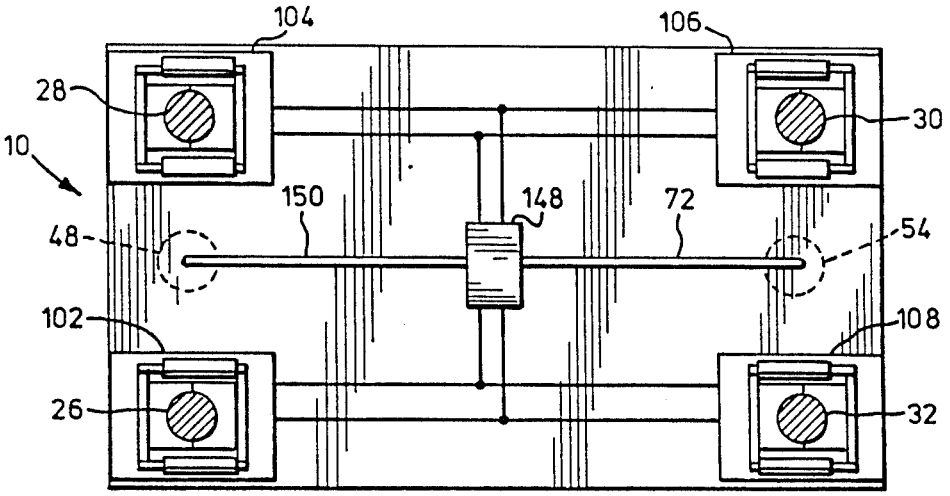
FIG. 3 is a view along the lines 3—3 of FIG. 2 indicating the location of various locking mechanisms which serve to fasten an upper platen associated with the press to certain posts; and, FIG. 4 is an isometric view of one of the locking mechanisms.

It should be noted that all four locking mechanisms 102–108 are operated simultaneously with hydraulic fluid received from the rapid advance cylinder 54. The expansion and contraction of the cylinders associated with all locking mechanisms is simultaneously regulated by the flow switching valve 148 (which directs the flow of the hydraulic fluid from the rapid advance cylinder 54). Return fluid flows from all locking mechanisms 102–108 are directed by the switching valve 148 to the other rapid advance cylinder. It should also be noted that the various hydraulic fluid lines extending between the flow switching valve 148 and the eight hydraulic cylinders associated with the locking mechanisms 102–108 have only been schematically illustrated in FIG. 3. The required installation of such hydraulic fluid lines will be readily apparent to those skilled in the art of press design and the operation of hydraulic cylinders.

The relationship between the shoulders and the lowermost recesses formed on the posts 26–32 should be noted. In particular, the shoulder 100 of the post 30 is separated from the recess 96 by a predetermined distance. The separation is such that, when the upper platen 20 stops against the shoulder 100, the recess 96 and locking mechanism 106 are precisely positioned for interlocking. The shoulders and recesses on the other posts are similarly spaced. This arrangement ensure consistent and positive locking of the upper platen 20 to the posts 26–32. The shoulders also provide a positive stop against lowering of the upper platen 20, and permit the platen 20 to be consistently positioned substantially parallel to the lower platen 24 upon commencement of the compression phase, whenever the compression-phase cylinders have previously been fully extended.

The upper platen 20 may by virtue of the various recesses provided on the posts be locked to the posts 26–32 in alternative position. The relative alignment of the recesses may be adjusted so that sets of recesses, each set including one recess from each post, can be simultaneously engaged by the locking mechanisms. For example, the recess 92 can be aligned (substantially in a common horizontal plane) with the recesses 152, 154, 156 on the posts 26, 28, 32, respectively, by appropriate extension of the various compression-phase cylinders. The locking mechanisms 102–108 may then be simultaneously engaged with the set of recess 92, 152, 154, 156. There are in fact four different positions at which the upper platen 20 can be locked to the posts 25–30, as will be apparent from FIG. 1, corresponding to four different sets of recesses. By providing substantially identical posts 26–32, it is possible to ensure simultaneous alignment of the various sets of recesses with the alignment of the various shoulders upon full extension of the compression-phase cylinders. Movement of the upper platen 20 may be sensed to ensure that the lock mechanisms 102–108 properly engage with the desired set of recesses, if the platen 20 is not abutted directly against the shoulders formed on the posts. It should be noted that the upper three sets of recesses are intended primarily to permit the upper platen to be locked for an extended period of time if required for maintenance without loading the rapid advance cylinders 48, 54. Accordingly, the upper three recesses of each post have considerable vertical play to permit easy engagement by the locking mechanisms. The lower recesses of the posts are intended for platen latching during the compression phase of operation, and proper engagement of the locking mechanisms 102–108 with these lowermost recesses is ensure primarily by full extension of the compression phase cylinders and abuttment of the upper platen 20 against the shoulders formed on the posts.

The press 10 can be adapted for parallelism control between the platens 14, 20. Four sensors are provided for sensing the spacing between the upper and lower platens proximate to different ones of the four compression-phase cylinders and the associated posts. In FIG. 1, three such sensors 158, 160, 162 have been illustrated. These are standard linear transducers each having a stationary member concealed within the lower platen 14 and a moving member fixed to the upper platen 20. The transducers are associated with control circuitry which regulates supply of hydraulic oil to the compression-phase cylinders in such a manner as to maintain a substantially parallel relationship between the upper and lower platens (more specifically, between their T-slotted bolster plates) during compression of a workpiece. Sensing and hydraulic control arrangements are known in the art, and consequently will not be discussed in further detail. The sensors may be used, quite apart from applications requiring strict parallelism control, to sense displacement of the upper platen 20 for the purpose of ensuring proper alignment and engagement of the locking mechanisms 102–108 with various sets of post recesses.

The general operation of the press 10 will now be described in the context of a compression molding process. The upper platen 20 may initially be locked to the uppermost recesses of the posts 26–32. Upper and lower mold halves are bolted to the upper and lower platens, and a molding charge placed in the interior of the lower mold half. The compression-phase hydraulic cylinders 44, 46, 50, 52 may then be fully extended so that the shoulders associated with the vertical posts 26–32 are horizontally aligned to define a stop for the upper platen 20. The rapid advance cylinders 48, 54 can then be actuated to take up the load of the upper platen 20, and the locking mechanisms 102–108 associated with the upper platen 20 released from the uppermost post recesses. The rapid advance cylinders can then be used to lower the upper platen 20 onto the stop defined by the shoulders. With the upper platen 20 now resting on the post shoulders a predetermined distance above and substantially parallel to the lower platen 14, the four locking mechanisms 102–108 can be actuated to lock the upper platen 20 to the four posts 26–32. The compression-phase hydraulic cylinders can then be actuated to draw the four posts 26–32 downwardly towards the base structure 12, thereby advancing the upper platen 20 towards the lower platen 14 to compress the mold halves and the charge. During this compression phase, the parallel relationship between the lower and upper platens 14, 20 may be regulated by the various spacing sensors and associated controls. Following completion of the compression phase, the compression-phase cylinders are extended, thereby separating the mold halves, preferably until the compression-phase cylinders are once again fully extended. The locking mechanisms 102–108 can then be released to disengage the upper platen 20 from the four posts 26–32, the load of the upper platen 20 being taken up by the rapid advance cylinders 48, 54. The upper platen 20 can then be quickly raised by the rapid advance cylinders relative to the four posts to permit removal of the molded product and re-start of the molding cycle. Once operation is discontinued, the rapid advance cylinders can be used to raise the upper platen 20 to a position where the locking mechanisms 102–108 can latch the upper platen 20 to the one of the three uppermost sets of post recesses.

It should also be noted that any appropriate mechanism can be substituted to perform the platen displacement function of the rapid advance cylinders. However, these cylinders are regarded as the most convenient mechanism for rapidly varying the separation between the lower and upper platens 14, 20. Also, in alternative embodiments of the press other locking mechanisms may be substituted for those described to lock the upper platen 20 to the four posts 26–32 during the compression phase of operation. In particular, the recesses associated with the posts may be eliminated, and a friction braking mechanism may be provided that permits the upper platen to be fixed to the posts by friction at any desired height. Such a friction locking arrangement would, however, likely be more expensive than the arrangement of recesses which permits locking of the upper platen at intervals along the posts.

It will be appreciated by those skilled in the art of press design that the press described and illustrated lends itself to comparatively inexpensive manufacture. The side slabs and massive cross-head associated with more common press designs have been eliminated. Use of a comparatively expensive long-stroke, large-bore ram is avoided. A comparatively inexpensive mechanism is provided to permit fixing of the upper moving platen to the associated posts at various position to accommodate molds of different size. It will also be appreciated that the various advantages and cost savings associated with the press make the design attractive even if not adapted for parallelism control.

The operation of the press 10 has been discussed in connection with a compression molding process. It should be noted, however, that the press 10 can also be advantageously used in connection with injection molding processes to conveniently hold mold members in a closed orientation against injection of thermoplastic materials under high pressure. In particular, the construction of the press 10 permits the lower platen 14 to remain stationary, and accordingly, the nozzle of an extruder used in conjunction with an injection molding process can be introduced between the upper and lower platens, most preferably proximate to the stationary lower platen 14, without fear that the nozzle will be snapped by platen movement.

It will be appreciated that a particular embodiment of the invention has been described, and that modifications may be made therein without departing from the spirit of the invention or the scope of the appended claims.

We claim:

1. A press comprising:

a base structure which includes a lower platen;

a multiplicity of vertical posts;

guide means attached to the base structure and continually engaged with the posts for rigidly guiding the posts to move vertically relative to the base structure;

hydraulic cylinder means attached to the base structure for raising and lowering the posts;

an upper platen guided solely on the posts for vertical movement relative to the lower platen;

upper platen displacement means for moving the upper platen relative to the posts; and, controllable locking means for releasably locking the upper platen to the vertical posts.

2. A press as claimed in claim 1 in which the hydraulic cylinder means comprise a multiplicity of hydraulic cylinders, each of the multiplicity of hydraulic cylinders having a body member fixed to a lower portion of the base structure and a piston rod extending upwardly from the body member and oriented for vertical movement relative to the body member, each of the piston rods being attached to a different one of the posts.

3. A press as claimed in claim 2 in which the upper platen displacement means comprise a plurality of hydraulic cylinders, each of the plurality of hydraulic cylinders having a body member fixed to the base structure and a piston rod oriented for vertical movement relative to the body member and attached to the upper platen.

4. A press as claimed in claim 3 in which the controllable locking means comprise a multiplicity of locking mechanisms mounted on the upper platen, the locking mechanism being operable to engage and disengage the posts.

5. A press as claimed in claim 4 in which:

each post is formed with a plurality of vertically spaced-apart recesses;

the multiplicity of locking mechanisms are horizontally aligned and adapted to engage the recesses formed in the posts;

the recesses of the posts are so alignable that the locking mechanisms can simultaneously engage at least two different sets of recesses, each of the sets of recesses including one recess of each post;

whereby the upper platen may be locked to the posts at a plurality of positions on the posts.

6. A press comprising:

a base structure which includes a lower platen and a lower platen bolster plate defining an upper surface of the lower platen;

a multiplicity of hydraulic cylinders each having a body member fixed to the base structure below the lower platen bolster plate and a piston rod extending upwardly from the body member;

a multiplicity of vertical posts extending upwardly through the lower platen bolster plate, each of the vertical posts being attached to a different one of the piston rods for vertical movement with the associated piston rod;

guide means attached to the base structure and continually engaged with the posts for rigidly guiding the posts for vertical movement relative to the lower platen;

an upper movable platen interfitted with and rigidly guided solely by the posts for vertical movement relative to the lower platen, the upper platen having an upper platen bolster plate defining a lower surface of the upper platen through which lower surface the posts extend vertically;

upper platen displacement means for moving the upper platen vertically relative to the posts; and, controllable locking means for releasably locking the upper platen to the vertical posts.

7. A press as claimed in claim 6 in which the upper platen displacement means comprise a plurality of hydraulic cylinders, each of the plurality of hydraulic cylinders having a body member fixed to the base structure and a piston rod oriented for vertical movement relative to the body member and attached to the upper platen.

8. A press as claimed in claim 7 in which the controllable locking means comprise a multiplicity of locking mechanisms mounted on the upper platen, the locking mechanisms being hydraulically operable to engage and disengage the posts.

9. A press as claimed in claim 8 in which:

each post is formed with a plurality of vertically spaced-apart recesses;

the multiplicity of locking mechanisms are horizontally aligned and adapted to engage the recesses formed in the posts;

the recesses of the posts being so alignable that the locking mechanisms can simultaneously engage at least two different sets of recesses, each of the sets of recesses including one recess of each post;

whereby the upper platen may be locked to the posts at a plurality of positions on the posts.

* * * * *